US007255614B1

(12) United States Patent
Irish et al.

(10) Patent No.: US 7,255,614 B1
(45) Date of Patent: Aug. 14, 2007

(54) ELECTRICAL TERMINAL

(75) Inventors: Kenneth G. Irish, Chicago, IL (US); James A. Turek, Ann Arbor, MI (US); Kevin Russelburg, Lemont, IL (US)

(73) Assignee: Illinois Tool Works Inc, Glenview, IL (US)

( * ) Notice: Subject to any disclaimer, the term of this patent is extended or adjusted under 35 U.S.C. 154(b) by 0 days.

(21) Appl. No.: 11/478,871

(22) Filed: Jun. 30, 2006

(51) Int. Cl.
*H01R 13/11* (2006.01)

(52) U.S. Cl. ..... 439/849

(58) Field of Classification Search ..... 439/849, 439/850, 851, 746, 748, 872
See application file for complete search history.

(56) References Cited

U.S. PATENT DOCUMENTS 2,774,055 A * 12/1956 Batcheller ..... 439/849
3,215,975 A * 11/1965 Kinkaid ..... 439/850
3,228,207 A * 1/1966 Hartmann, Jr. et al ..... 439/849
3,550,069 A * 12/1970 Teagno et al. ..... 439/849
4,458,971 A * 7/1984 D'Urso et al. ..... 439/268
4,592,611 A * 6/1986 Nitschke ..... 439/345
4,696,530 A * 9/1987 Vandame ..... 439/266
5,800,220 A * 9/1998 Feeny et al. ..... 439/849
6,039,615 A * 3/2000 Suzuki ..... 439/849
6,293,831 B1 * 9/2001 Yamatani ..... 439/850

* cited by examiner

*Primary Examiner*—Tulsidas C. Patel
*Assistant Examiner*—Vladimir Imas
(74) *Attorney, Agent, or Firm*—Mark W. Croll; Paul F. Donovan

(57) ABSTRACT

An electrical terminal configured to electrically mate with a conductive blade may include a base integrally formed with lateral walls, at least one spring member, and at least one contact rib. The spring member extends from at least one of the lateral walls, and is configured to contact a first surface of the conductive blade. The contact rib extends from an upper surface of the base, and is configured to contact a second surface of the conductive blade. The spring member may include an extension beam angled toward the base, with a tip of the extension beam being canted away from the base, so as not to snag the conductive blade.

19 Claims, 4 Drawing Sheets

ELECTRICAL TERMINAL

BACKGROUND OF THE INVENTION

Field of the Invention

Embodiments of the present invention generally relate to an electrical terminal, and more particularly, to an electrical terminal that is configured to be easily connected to, and disconnected from, a reciprocal conductive element, such as a conductive electrical blade.

Electrical terminals are used in many electrical assemblies, systems and applications. For example, electrical terminals may be used to electrically connect a conductive wire to a conductive blade in applications such as cable harnesses, electrical motors, and switches in appliances.

FIG. 1 illustrates a top isometric view of a conventional electrical terminal 10. The terminal 10 includes an insulation crimp barrel 12 integrally connected to a wire crimp barrel 14, which is in turn integrally connected to a blade retaining housing 16. The insulation crimp barrel 12 and the wire crimp barrel 14 are configured to retain an electrical wire (not shown) in which the insulation crimp barrel 12 securely retains the insulated portion of the electrical wire, while the wire crimp barrel 14 securely retains the exposed portion of the electrical wire.

The blade retaining housing 16 includes a base 18 integrally formed with two lateral walls 20. Each lateral wall 20 includes a spring-biased hook 22 having an exposed edge 24 oriented toward the base 18. A conductive member, such as an electrical blade (not shown) is configured to be retained within a blade chamber 26 defined by the base 18, the lateral walls 20, and the spring-biased hooks 22. A bottom surface of the blade abuts against the base 18, while lateral portions may abut against the lateral walls 20. The edges 24 of the spring-biased hooks 22 of the lateral walls 20 abut a top portion of the blade.

FIG. 2 illustrates a side cross-sectional view of the electrical terminal 10 through line 2-2 of FIG. 1. FIG. 3 illustrates a front cross-sectional view of the electrical terminal 10 through line 3-3 of FIG. 1. Referring to FIGS. 2 and 3, in order to secure the blade within the blade chamber 26, a tab 28 upwardly extending from the base 18 is configured to securely mate into a reciprocal opening (not shown) of the blade.

The tab 28 includes a ramped surface 30 proximate a blade entrance 32. The ramped surface 30 terminates at an edge 34. Typically, the blade is mated into the blade chamber 26 through the blade entrance 32. The bottom surface of the blade slides over the base 18, while the top surface of the blade slides under the exposed edges 24 of the spring members 22 until the reciprocal opening of the blade snapably engages the tab 28. The reciprocal opening of the blade slides over the ramped surface 30 of the tab 28 until an edge defining the reciprocal opening snapably engages the edge 34 of the tab 28. As such, the blade is retained within the blade chamber 26.

In order to remove the blade, the blade is urged away from the terminal 10. During the removal process, however, the blade may snag on the tab 28, due to the interaction of the edge 34 of the tab 28, and the reciprocal opening of the blade. Thus, a relatively large amount of force (when compared with the insertion process) may be used to remove the blade from the terminal 10. Moreover, during the removal process, the blade and/or the terminal may be damaged, such as by the blade snagging and pulling on the tab, and/or the tab 28 digging into the blade.

Additionally, in order to maintain contact with the blade, the spring members 22 typically exert a relatively high amount of force into the blade, in order to compressively sandwich the blade between the edges 24 of the spring members 22 and the base 18. The force exerted by the spring members 22, however, may also cause difficulty in inserting or removing the blade from the terminal 10. For example, the edges 24 of the spring members 22 may scrape and/or dig into the blade, thereby damaging the blade.

Thus, a need exists for an electrical terminal that may be easily connected to, and disconnected from, a conductive blade. Further, a need exists for an electrical terminal that is less susceptible to damaging the blade.

SUMMARY OF THE INVENTION

Certain embodiments of the present invention provide an electrical terminal configured to electrically mate with a conductive blade. The terminal comprises a base integrally formed with lateral walls, at least one spring member extending from at least one of the lateral walls, and at least one contact rib extending from an upper surface of the base. The spring member is configured to contact a first surface, such as an upper surface, of the conductive blade, and the contact rib is configured to contact a second surface, such as a bottom surface, of the conductive blade.

Certain embodiments of the present invention provide an electrical terminal including a plurality of spring members extending from at least one of the lateral walls. The spring members are configured to contact an upper surface of the conductive blade. Each spring member may include an extension beam angled toward the base, and the extension beam may include a tip canted away from the base so that the tip is oriented away from the conductive blade.

Certain embodiments of the present invention provide an electrical connector assembly including a blade housing having a plurality of conductive blades extending therefrom, a terminal housing having a plurality of terminal chambers, and a plurality of electrical terminals. Each terminal chamber includes a terminal securing member, and each electrical terminal includes a deflectable housing securing member, wherein each of the electrical terminals are securely retained within a terminal chamber through the housing securing member snapably securing to the terminal securing member.

Figure 1:
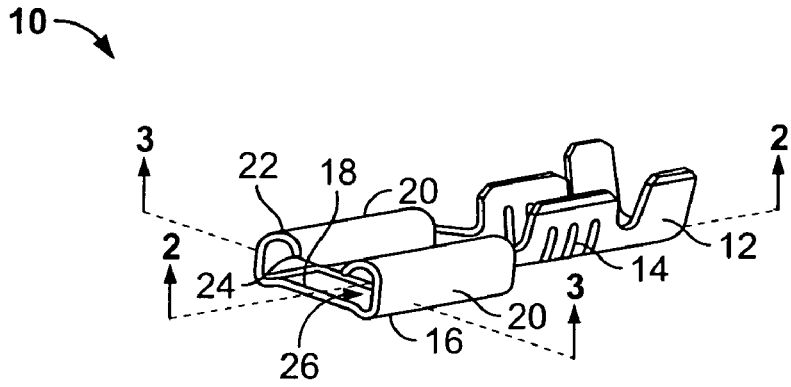
FIG. 1 (Prior Art)
FIG. 1 illustrates a top isometric view of a conventional electrical terminal.
Figure 2:
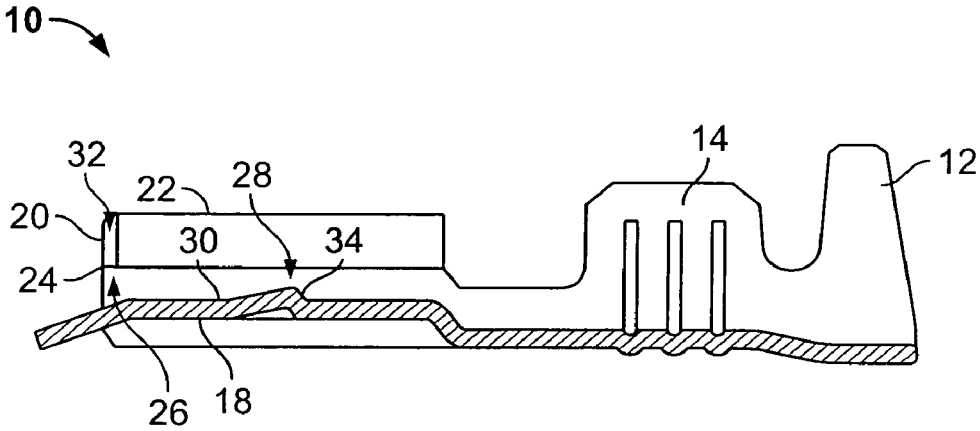
FIG. 2 (Prior Art)
FIG. 2 illustrates a side cross-sectional view of an electrical terminal through line 2-2 of FIG. 1.
Figure 3:
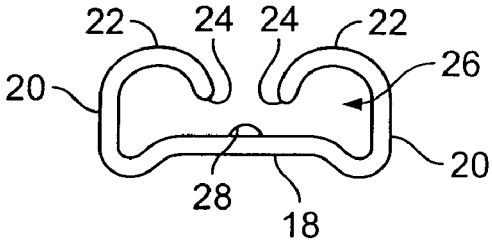
FIG. 3 (Prior Art)
FIG. 3 illustrates a front cross-sectional view of an electrical terminal through line 3-3 of FIG. 1.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE INVENTION

Figure 4:
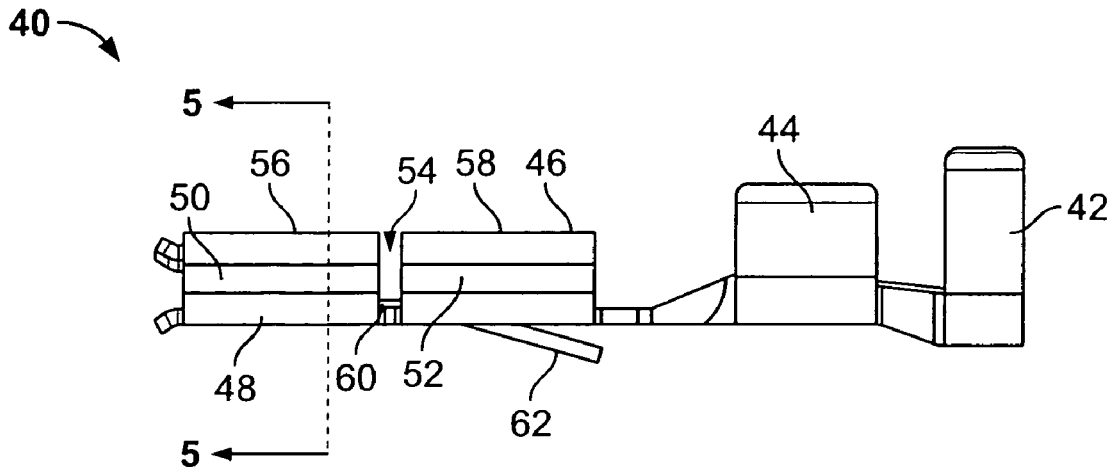
FIG. 4 illustrates a side view of an electrical terminal according to an embodiment of the present invention.

FIG. 4 illustrates a side view of an electrical terminal 40 according to an embodiment of the present invention. The terminal 40 includes an insulation crimp barrel 42 integrally connected to a wire crimp barrel 44, which is integrally connected to a blade retaining housing 46. The blade retaining housing 46 includes a base 48 integrally connected to front lateral walls 50 and rear lateral walls 52. The front and rear lateral walls 50 and 52 are separated by a gap 54. Front spring members 56 are integrally connected to the front lateral walls 50, while rear spring members 58 are integrally connected to the rear lateral walls 52. The spring members 56 and 58 may be spring-biased beams configured to exert a compressive force into a conductive blade. Thus, the electrical terminal 40 includes four spring members, two front spring members 56, and two rear spring members 58. Alternatively, the electrical terminal 40 may include more or less spring members than those shown.

Parallel contact ribs 60 extend over a top surface of the base 48, while a housing securing member 62 extends downwardly from a lower surface of the base 48. As shwon in FIG. 4, the housing securing member 62 may be a beam extending from a lower surface of the base 48 at an angle. Optionally, the housing securing member 62 may be a ramp, tab, bar, clasp, or other such structure.

Figure 5:
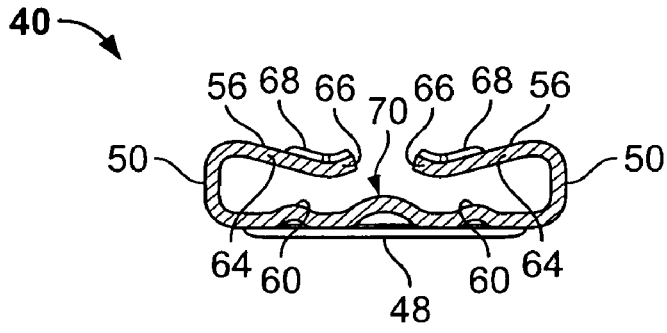
FIG. 5 illustrates a cross-sectional view of an electrical terminal through line 5-5 of FIG. 4 according to an embodiment of the present invention.

FIG. 5 illustrates a cross-sectional view of the electrical terminal 40 through line 5-5 of FIG. 4. The front spring members 56 include extension beams 64 that are angled toward the base 48. The angled nature of the spring members 56 provides a spring force configured to urge the spring members 56 into a blade (not shown in FIG. 5). The distal tips 66 of the extension beams 64 are upwardly angled so as to ensure that the distal tips 66 do not dig into, or snag the blade. While only the front spring members 56 are shown in FIG. 5, the rear spring members 58 (shown in FIG. 4) may be similarly configured.

Braces 68 may be positioned on top of the spring members 56 proximate the distal tips 66. The braces 68 ensure that the distal tips 66 do not bend back. The braces 68 may also assist in maintaining the angle of the extension beams 64 with respect to the lateral walls 50. The braces 68 further provide a lead-in feature to inhibit the mating tab from stubbing.

The contact ribs 60 extend over the top surface of the base 48 and are positioned underneath the front extension beams 64 (and the rear extension beams of the rear spring members 58). The contact ribs 60 are configured to contact the underside of the blade. While two contact ribs 60 are shown, the terminal 40 may include more or less contact ribs 60 than two.

The terminal 40 is configured to compressively sandwich the blade between the front and rear spring members 56 and 58, and the contact ribs 60. Thus, in the embodiment shown, the terminal 40 makes conductive contact with the blade at six different areas: the two front spring members 56 and the two rear spring members 58 contact the top surface of the blade, while the two contact ribs 60 contact the underside of the blade along a substantial length of the blade within the blade chamber.

A blade securing dimple 70 may extend upwardly from a central area of the upper surface of the base 48. The blade securing dimple 70 is a smooth, rounded symmetrical protrusion that does not have any distinct sharp edges. As such, the dimple 70 does not include any area that can snag or dig into the blade. The dimple 70 is configured to securely mate with a reciprocal opening (not shown) of a blade.

Figure 6:
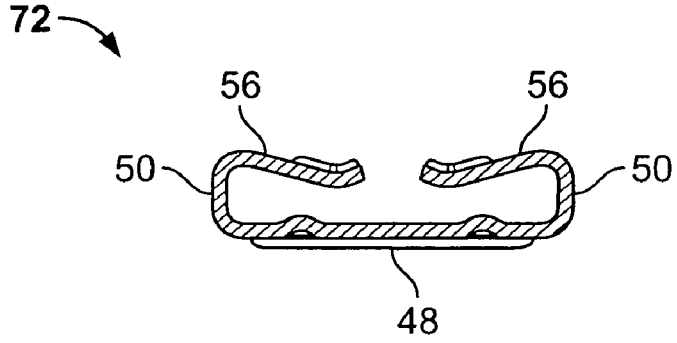
FIG. 6 illustrates a cross-sectional view of an electrical terminal through line 5-5 of FIG. 4 according to an embodiment of the present invention.

FIG. 6 illustrates a cross-sectional view of an electrical terminal 72 through line 5-5 of FIG. 4 according to an embodiment of the present invention. The electrical terminal 72 is the same as the electrical terminal 40, except that the electrical terminal 72 does not include the dimple 70.

Figure 7:
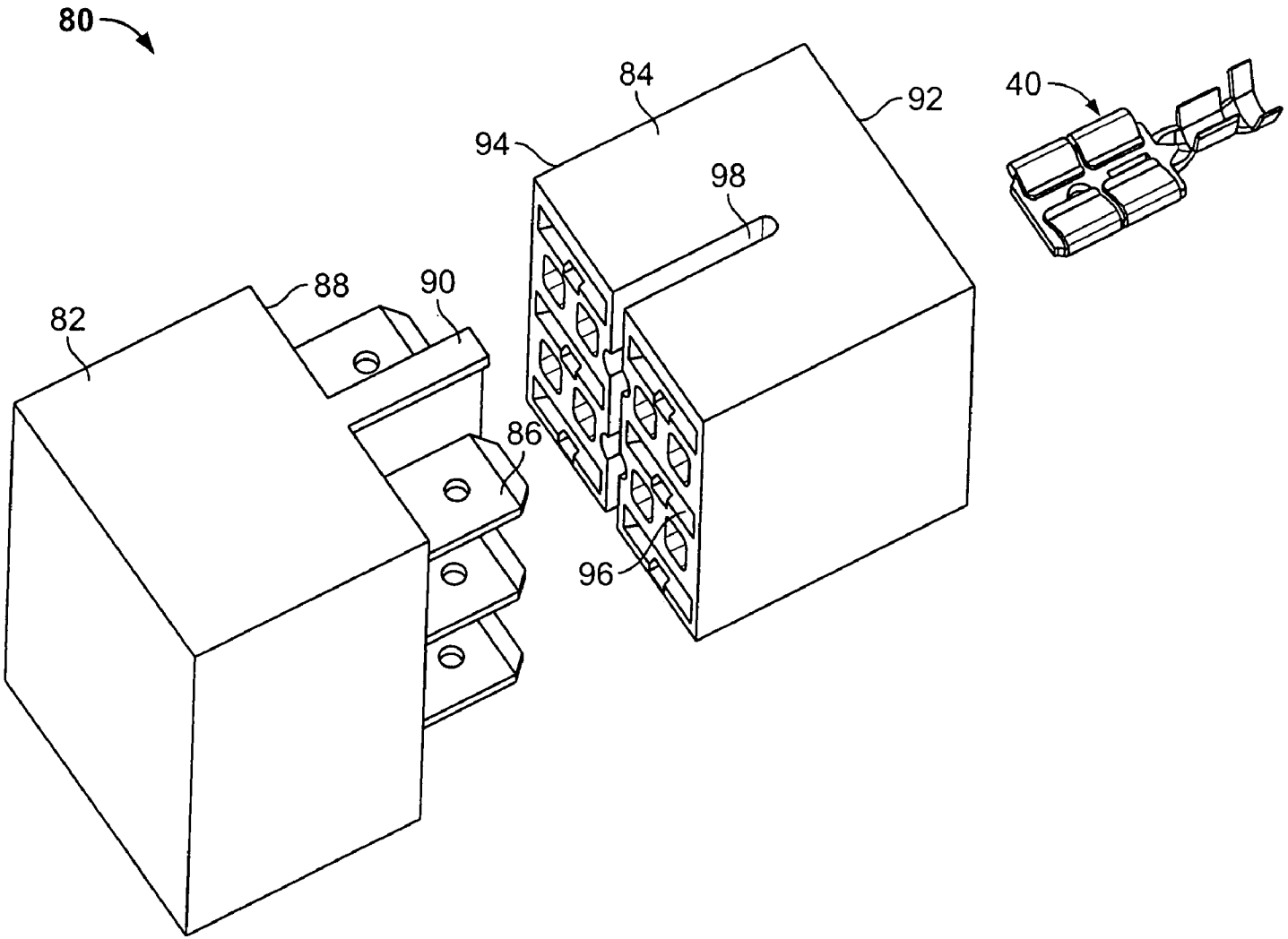
FIG. 7 illustrates an isometric exploded view of an electrical connector assembly according to an embodiment of the present invention.

FIG. 7 illustrates an isometric exploded view of an electrical connector assembly 80 according to an embodiment of the present invention. The electrical connector assembly 80 includes a plug or blade housing 82 configured to removable connect to a terminal housing 84. The blade housing 82 includes a plurality of conductive blades 86 extending from a front surface 88. An alignment wall 90 may extend down a central longitudinal area of the front surface 88.

The terminal housing 84 is configured to receive and retain a plurality of electrical terminals 40. The electrical terminals 40 are loaded through a rear wall 92 of the terminal housing 84, and are configured to electrically mate with the conductive blades 86 through a front surface 94 of the terminal housing 84. For example, a plurality of blade openings 96 are formed through the front surface 94. The blade openings 96 are entrances to terminal chambers (not shown in FIG. 7) that retain the terminals 40. The blades 86 are configured to pass through the openings 96 and mate with the terminals 40 within the terminal chambers.

The terminal housing 84 may also include an alignment channel 98 formed through a longitudinal area of the front surface 94. The alignment channel 98 is configured to receive and retain the alignment wall 90 of the blade housing 82 to ensure that the blade housing 82 properly mates with the terminal housing 84. Alternatively, the terminal housing 84 may include the alignment wall, while the blade housing 82 includes the alignment channel.

Figure 8:
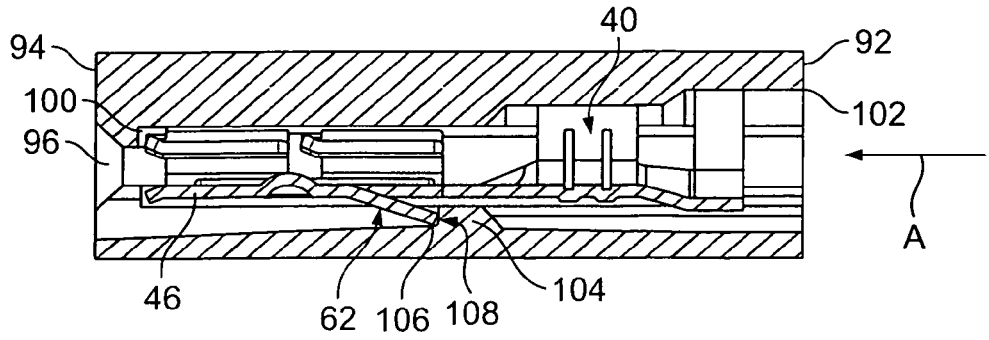
FIG. 8 illustrates a side view of an electrical terminal within a terminal chamber according to an embodiment of the present invention.

FIG. 8 illustrates a side view of an electrical terminal 40 within a terminal chamber 100. As noted above, the terminal chamber 100 connects to the blade opening 96. In order to load the terminal 40 into the terminal chamber 100, the terminal 40 is urged into the terminal chamber 100 in the direction of arrow A through an opening 102 in the rear wall 92 such that the blade retaining housing 46 of the terminal 40 enters the terminal chamber 100 first. As the first terminal 40 continues to be urged in the direction of arrow A, the securing member 62 of the terminal slides over a ramp 104. The securing member 62 deflects upwardly during this movement, until the edge 106 of the securing member 62 encounters the edge 108 of the ramp 104. At this point, the securing member 62 snaps downwardly such that the edge 106 of the securing member 62 abuts against the edge 108 of the ramp 104, thereby wedging the terminal 40 into the terminal chamber 100.

Figure 9:
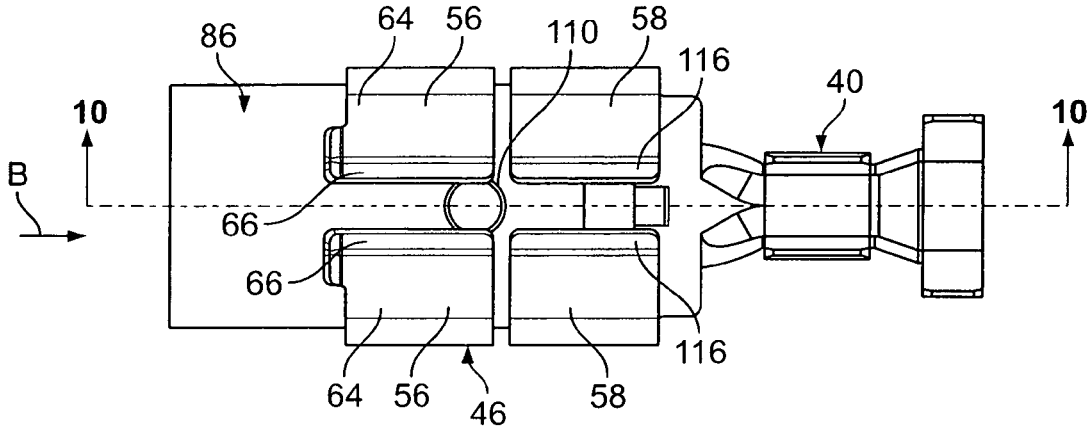
FIG. 9 illustrates a top view of an electrical terminally securely mated with a conductive blade according to an embodiment of the present invention.
Figure 10:
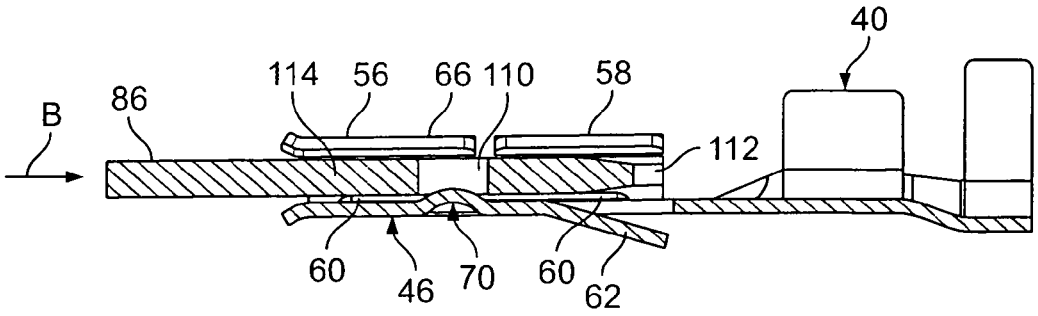
FIG. 10 illustrates a cross-sectional view of an electrical terminal and conductive blade through line 10-10 of FIG. 9 according to an embodiment of the present invention.

FIG. 9 illustrates a top view of an electrical terminal 40 securely mated with a conductive blade 86 according to an embodiment of the present invention. FIG. 10 illustrates a cross-sectional view of the electrical terminal 40 and conductive blade 86 through line 10-10 of FIG. 9. Referring to FIGS. 9 and 10, the blade 86 is mated into the terminal 40 in the direction of arrow B. The spring members 56 and 58 slide over the top surface of the blade 86, while the contact ribs 60 slide over the bottom surface of the blade 86 until the rounded dimple 70 mates into a reciprocal opening 110 of the blade 86. Additionally, the rear 112 of the blade chamber 114 may be narrow or closed in order to stop further movement of the blade 86 through the blade chamber 114.

As shown in FIGS. 9 and 10, the electrical terminal 40 contacts the conductive blade 86 at six distinct locations: the two spring members 56 contact the top surface of the blade 86 proximate the front of the blade retaining housing 46; the two spring members 58 contact the top surface of the blade 86 proximate the rear of the blade retaining housing 46, and the two contact ribs 60 (only one rib 60 shown in FIG. 10) contact an underside of the blade 86. Because the dimple 70 is rounded and smooth, the dimple 70 does not have any distinct edges to snag or dig into the blade 86 upon insertion or withdrawal. Further, because the distal tips 66 and 116 of the front and rear spring members 56 and 58, respectively, are turned upward, the spring members 56 and 58 do not have any sharp edges that can dig into or scrape the upper surface of the blade 86.

While the electrical terminal 40 is shown having a dimple, the electrical terminal 72 (shown in FIG. 6) without the dimple may be used in applications with a large number of blades 86. For example, in an electrical connector assembly (such as shown in FIG. 7) that includes a small number of blades 86, the dimples 70 may be used to provide additional retaining strength. However, if a large number (e.g., six or more) of blades 86 are used in a connector assembly, the blade housing may securely mate to the terminal housing through the conductive beams 86 being compressively sandwiched between the spring members and the contact ribs.

Thus, embodiments of the present invention provide an electrical terminal that may be easily connected to, and disconnected from, a conductive blade. Further, embodiments of the present invention provide an electrical terminal that is less susceptible to damaging the blade due to a lack of distinct edges that contact the blade.

While various spatial terms, such as upper, lower, mid, lateral, horizontal, vertical, and the like may used to describe portions of the electrical terminal and/or connector assembly, it is understood that such terms are merely used with respect to the orientation shown in the drawings. The orientations may be inverted, rotated, or otherwise changed, such that an upper portion is a lower portion, and vice versa, horizontal becomes vertical, and the like.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

The invention claimed is:

1. An electrical terminal configured to electrically mate with a conductive blade, comprising:

a base integrally formed with front lateral walls and rear lateral walls, said front and rear lateral walls separated by a gap;

front spring members extending from said front lateral walls, and rear spring members extending from said real lateral walls, said front and rear spring members configured to contact a first surface of the conductive blade, and said front and rear spring members being bifurcated so as to be adapted to independently exert an associated compressive force onto the first surface of the conductive blade; and at least one contact rib extending from an upper surface of said base, said at least one contact rib configured to contact a second surface of the conductive blade.

2. The electrical terminal of claim 1, wherein said front and rear spring members each include an extension beam angled toward said base, each said extension beam having a tip canted away from said base.

3. The electrical terminal of claim 1, wherein said at least one contact rib comprises two parallel contact ribs extending over a length of said base.

4. The electrical terminal of claim 1, further comprising a rounded dimple extending from an upper surface of said base, said dimple configured to be retained by a reciprocal opening formed through said conductive blade.

5. The electrical terminal of claim 1, further comprising a housing securing member extending from a lower surface of said base, said housing securing member configured to secure the electrical terminal within a terminal chamber of a terminal housing.

6. An electrical terminal configured to electrically mate with a conductive blade, comprising:

a base integrity formed with lateral walls; and a plurality of spring members extending from at least one of said lateral walls, each of said plurality of spring members configured to contact an upper surface of the conductive blade, each of said plurality of spring members comprising an extension beam having a contact portion angled toward said base, said extension beam further having a distal tip extending from said contact portion and canted away from said base so that said distal tip is oriented away from the conductive blade, such that said contact portion is configured to engage the conductive blade and said distal tip if configured to not engage the conductive blade.

7. The electrical terminal of claim 6, further comprising a plurality of contact ribs extending from an upper surface of said base, said plurality of contact ribs configured to contact a bottom surface of the conductive blade.

8. The electrical terminal of claim 7, wherein said plurality of contact ribs comprises two parallel contact ribs extending over a length of the upper surface of said base.

9. The electrical terminal of claim 6, wherein said plurality of spring members comprises a first set of spring members separated from a second set of spring members by a gap.

10. The electrical terminal of claim 6, further comprising a rounded dimple extending from an upper surface of said base, said dimple configured to be retained by a reciprocal opening formed through said conductive blade.

11. The electrical terminal of claim 6, further comprising a housing securing member extending from a lower surface of said base, said housing securing member configured to secure the electrical terminal within a terminal chamber of a terminal housing.

12. An electrical connector assembly, comprising:

a blade housing having a plurality of conductive blades extending therefrom;

a terminal housing comprising a plurality of terminal chambers, each of said terminal chambers having a terminal securing member; and a plurality of electrical terminals, each of said plurality of electrical terminals comprising a base integrally formed with lateral walls extending upwardly from an upper surface thereof, and a deflectable housing securing member extending downwardly from a lower surface of said base, wherein each of said plurality of electrical terminals are securely retained within a separate one of said plurality of terminal chambers through said housing securing member snapably securing to said terminal securing member, wherein each of said plurality of electrical terminals comprises a plurality of spring members extending from at least one of said lateral walls, each of said plurality of spring members configured to contact an upper surface of one of said plurality of conductive blades, each of said plurality of spring members comprising an extension beam angled toward said base, said extension beam having a tip canted away from said base.

13. The electrical connector assembly of claim 12, wherein said terminal securing member comprises a ramp having a ramped surface integrally connected to an edge.

14. The electrical connector assembly of claim 12, wherein said housing securing member is at least one of an angled beam, barb, ramp, latch, and clasp.

15. The electrical connector assembly of claim 12, further comprising a plurality of contact ribs extending from said upper surface of said base, said plurality of contact ribs configured to contact a bottom surface of one of said plurality of conductive blades.

16. The electrical connector assembly of claim 15, wherein said plurality of contact ribs comprises two parallel contact ribs extending over a length of the upper surface of said base.

17. The electrical connector assembly of claim 12, wherein said plurality of spring members comprises a first set of spring members separated from a second set of spring members by a gap.

18. The electrical connector assembly of claim 12, further comprising a rounded dimple extending from said upper surface of said base, said dimple configured to be retained by a reciprocal opening formed through said conductive blade.

19. The electrical connector assembly of claim 12, wherein said terminal housing retains at least six electrical terminals within six terminal chambers.

* * * * *